US008113271B2

(12) United States Patent
Fuhst et al.

(10) Patent No.: US 8,113,271 B2
(45) Date of Patent: Feb. 14, 2012

(54) CUTTING TOOL FOR CUTTING A DOWNHOLE TUBULAR

(75) Inventors: Karsten Fuhst, Hannover (DE); Christian Weiner, Hannover (DE); Matthias Moeller, Brauschweig (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/091,485

(22) Filed: Apr. 21, 2011

(65) Prior Publication Data

US 2011/0192589 A1 Aug. 11, 2011

Related U.S. Application Data

(63) Continuation-in-part of application No. 12/541,035, filed on Aug. 13, 2009, which is a continuation-in-part of application No. 11/728,461, filed on Mar. 26, 2007, now Pat. No. 7,628,205.

(51) Int. Cl.
*E21B 29/00* (2006.01)

(52) U.S. Cl. ..... 166/55.7; 166/55

(58) Field of Classification Search ..... 166/55, 166/55.1, 55.7, 55.8, 298; 175/230
See application file for complete search history.

(56) References Cited

U.S. PATENT DOCUMENTS

| | | | | |
|---|---|---|---|---|
| 1,471,528 | A | 10/1923 | Pickin | |
| 1,476,481 | A | 12/1923 | Bashara | |
| 1,923,487 | A | 8/1933 | Howard | |
| 1,945,160 | A | 1/1934 | Pearce | |
| 2,357,835 | A | 9/1944 | Leissler | |
| 2,482,674 | A * | 9/1949 | Bernard Kriegel | 166/55.8 |
| 2,690,897 | A | 10/1954 | Clark | |
| 3,606,924 | A | 9/1971 | Malone | |
| 5,014,780 | A | 5/1991 | Skipper | |
| 5,018,580 | A * | 5/1991 | Skipper | 166/298 |
| 5,179,781 | A | 1/1993 | Weaver | |
| 5,477,759 | A | 12/1995 | Robinson | |
| 5,678,466 | A | 10/1997 | Wahl | |
| 6,056,072 | A | 5/2000 | Koltermann | |
| 6,568,489 | B1 | 5/2003 | Hailey | |
| 6,868,901 | B2 | 3/2005 | Mason et al. | |
| 7,628,205 | B2 * | 12/2009 | Fuhst et al. | 166/298 |
| 2001/0001935 | A1 | 5/2001 | Wilk | |
| 2001/0045146 | A1 | 11/2001 | Fisher | |
| 2002/0060073 | A1 | 5/2002 | Dewey | |
| 2003/0070812 | A1 | 4/2003 | Robertson | |

(Continued)

FOREIGN PATENT DOCUMENTS

| | | |
|---|---|---|
| WO | WO2008118725 | 10/2008 |

(Continued)

OTHER PUBLICATIONS

International Search Report dated Apr. 20, 2011 (9 pages).

(Continued)

*Primary Examiner* — Hoang Dang
(74) *Attorney, Agent, or Firm* — Bracewell & Giuliani LLP

(57) ABSTRACT

The tubular cutting tool for severing downhole tubulars, the tool having a drive system, a pivoting system, a cutting head, a cutting member, and a lubricant delivery system. Cutting may be accomplished by rotatingly actuating the cutting head with an associated motor and extending the cutting member away from the cutting head. The lubricant delivery system lubricates the respective contacting surfaces of the cutting member and the tubular and is actuated when the cutting member extends from the cutting head.

15 Claims, 4 Drawing Sheets

U.S. PATENT DOCUMENTS

| | | | | |
|---|---|---|---|---|
| 2003/0159826 | A1 | 8/2003 | Ohmer | |
| 2004/0045714 | A1 | 3/2004 | McGavern | |
| 2004/0089478 | A1 | 5/2004 | Cruickshank | |
| 2004/0140090 | A1 | 7/2004 | Mason | |
| 2005/0023044 | A1 | 2/2005 | Schuffenhauer | |
| 2005/0061551 | A1 | 3/2005 | DeGeare | |
| 2005/0133224 | A1* | 6/2005 | Ruttley | 166/298 |
| 2005/0145389 | A1 | 7/2005 | Barrow | |
| 2005/0150656 | A1 | 7/2005 | Stowe | |
| 2005/0173123 | A1 | 8/2005 | Lund | |
| 2005/0247171 | A1 | 11/2005 | Kawashima | |
| 2006/0011344 | A1 | 1/2006 | Lynde | |
| 2006/0137877 | A1 | 6/2006 | Watson | |
| 2006/0196671 | A1 | 9/2006 | Robichaux | |
| 2006/0233619 | A1 | 10/2006 | Kamiyama | |
| 2006/0254773 | A1 | 11/2006 | Schlegelmilch | |
| 2007/0000696 | A1 | 1/2007 | Laflin | |
| 2007/0017708 | A1 | 1/2007 | Radford | |
| 2007/0131410 | A1 | 6/2007 | Hill | |
| 2007/0181305 | A1 | 8/2007 | McGavern | |
| 2008/0236830 | A1 | 10/2008 | Fuhst et al. | |
| 2009/0294127 | A1 | 12/2009 | Krueger | |

FOREIGN PATENT DOCUMENTS

| | | | |
|---|---|---|---|
| WO | WO2011019926 | A2 | 2/2011 |

OTHER PUBLICATIONS

Written Opinion of the International Preliminary Examining Authority, Oct. 24, 2011, 4 pages.

* cited by examiner

CUTTING TOOL FOR CUTTING A DOWNHOLE TUBULAR

CROSS REFERENCE TO RELATED APPLICATIONS

This application is a continuation-in-part of and claims priority from co-pending U.S. application having Ser. No. 12/541,035, filed Aug. 13, 2009, which is a continuation-in-part of and claims priority from U.S. application having Ser. No. 11/728,461, filed Mar. 26, 2007, (now U.S. Pat. No. 7,628,205, issued on Dec. 8, 2009), the full disclosures of which are hereby incorporated by reference herein.

BACKGROUND OF THE INVENTION

1. Field of the Invention

The disclosure herein relates generally to the field of severing a tubular member. More specifically, the present disclosure relates to an apparatus for cutting downhole tubulars. Yet more specifically, described herein is a method and apparatus for optimizing cutting tubulars wherein lubrication is maintained between the cutting member and the tubular.

2. Description of Related Art

Tubular members, such as production tubing, coiled tubing, drill pipe, casing for wellbores, pipelines, structural supports, fluids handling apparatus, and other items having a hollow space can be severed from the inside by inserting a cutting device within the hollow space. As is well known, hydrocarbon producing wellbores are lined with tubular members, such as casing, that are cemented into place within the wellbore. Additional members such as packers and other similarly shaped well completion devices are also used in a wellbore environment and thus secured within a wellbore. From time to time, portions of such tubular devices may become unusable and require replacement. On the other hand, some tubular segments have a pre-determined lifetime and their removal may be anticipated during completion of the wellbore. Thus when it is determined that a tubular needs to be severed, either for repair, replacement, demolishment, or some other reason, a cutting tool can be inserted within the tubular, positioned for cutting at the desired location, and activated to make the cut. These cutters are typically outfitted with a blade or other cutting member for severing the tubular. In the case of a wellbore, where at least a portion of the casing is in a vertical orientation, the cutting tool is lowered into the casing to accomplish the cutting procedure.

BRIEF SUMMARY OF THE INVENTION

Disclosed herein is a cutting tool and method wherein lubrication is delivered during cutting. The system employs a rotating blade and a lubrication system for dispensing lubrication between the blade's cutting surface and the tubular to be cut. In an example embodiment the cutting tool includes a cutting member that can be moved between a stowed position within the housing and a cutting position in cutting contact with the tubular. The tool further includes a lubricant dispenser a reservoir for storing lubricant. The lubricant can be discharged through a passage that is directed towards the cutting member when the cutting member is in the cutting position. Control of lubricant flow can be maintained by a lubricant shuttle valve assembly that includes a valve body with a bore, a port through the body for communicating the lubricant with the bore, a shuttle member selectively moveable in the bore from a closed position to an open position and a recess in an outer surface of the shuttle member that registers with the port when the shuttle member is in the closed position and when the shuttle member is in the open position, the recess registers with the port and the inlet end of the lubricant discharge, so that the lubricant reservoir and discharge end of the lubricant discharge are in communication. An optional spring can be included for biasing a piston in the reservoir to urge lubricant from the reservoir and through the shuttle valve assembly. In an example embodiment, the recess defines an annulus between the shuttle member and the bore. The outer surface of the shuttle member, that is adjacent the bore, can project radially outward into sealing contact with an inner surface of the bore. This sealing contact can form a flow barrier between the annulus and the lubricant discharge when the shuttle member is in the closed position. In an example embodiment, the shuttle member is mechanically coupled to the cutting member when the cutting member is in the stowed position thereby retaining the shuttle member in the closed position. Alternatively, when the cutting member moves into the cutting position, a biasing spring in the bore urges the shuttle member into the open position. Optionally, a piston can be provided in the reservoir with an end attached to a fill tube for refilling the reservoir with lubricant and a check valve in the piston that defines a flow barrier through the piston for retaining lubricant in the reservoir. A housing may optionally be included the cutting member is mounted on a cutting assembly that pivots on the housing from a stowed into a cutting position, and wherein the cutting assembly includes a channel for directing lubricant from the discharge end of the lubricant discharge onto a side of the cutting member. The cutting tool can be deployed from the surface on wireline.

In another example embodiment, the cutting tool includes a housing, a cutting assembly with a cutting blade that moves between stowed and cutting positions, a reservoir for storing lubricant therein, passage having an inlet and a discharge directed towards the cutting member when the cutting member is in the cutting position, and a lubricant shuttle valve assembly. In an example embodiment, the shuttle valve assembly is made of a valve body with a smaller bore and an enlarged bore. The enlarged bore is adjacent to and coaxial with the smaller bore. A port is included through the body adjacent the smaller bore. Also included is a shuttle member with a smaller diameter section that forms an annulus between the shuttle member and the smaller bore. A larger diameter section on the shuttle member and adjacent the smaller diameter section is in sealing contact with the smaller bore when the within the smaller bore. When the shuttle member is positioned so the smaller diameter section is within both the smaller bore and the enlarged bore, the port and passage are in communication thereby providing lubrication communication to the cutting member. Alternatively, a piston is included in the reservoir that is biased with a spring towards the lubricant shuttle valve assembly to urge lubricant through the lubricant shuttle valve assembly. A cap may be provided on the cutting member to retain the shuttle member in the closed position when the cutting member is in the stowed position. A spring can be included and positioned so it is biased against the shuttle member for axially urging the shuttle member into the open position when the cutting member moves into the cutting position and disengages the cap from the shuttle member. The respective surfaces of the cap and shuttle member that are in contact may be profiled with a substantially similar slope.

BRIEF DESCRIPTION OF THE SEVERAL VIEWS OF THE DRAWING

Some of the features and benefits of the present invention having been stated, others will become apparent as the description proceeds when taken in conjunction with the accompanying drawings, in which.

Figure 1:
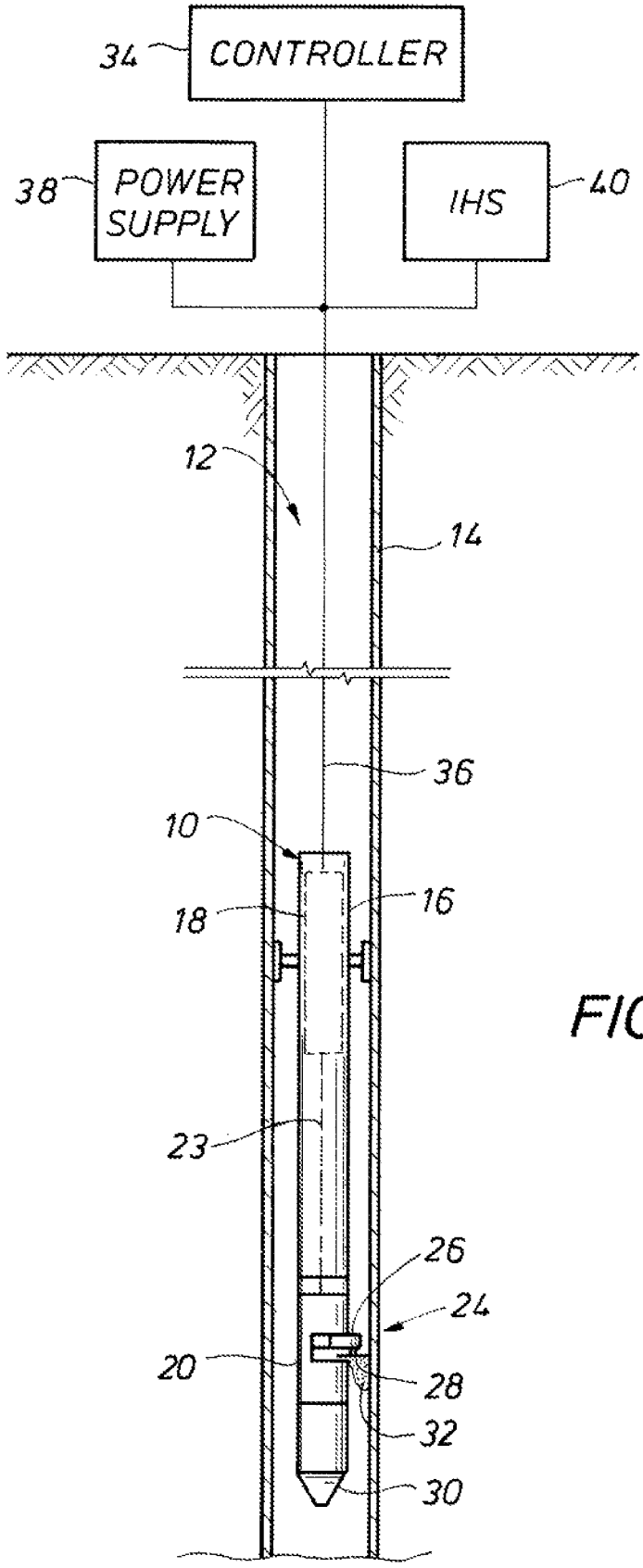
FIG. 1. is a partial sectional view of a cutting tool cutting a tubular in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be through and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Described herein is a method and apparatus for cutting and severing a tubular. While the apparatus and method described herein may be used to cut any type and length of tubular, one example of use involves severing tubing disposed within a wellbore, drill pipe, wellbore tubular devices, as well as wellbore casing. Shown in a side partial cut away view in FIG. 1 is an embodiment of a cutting tool 10 in a tubular 12 that is inserted into a wellbore 14. The tubular 12 can be any annular member, such as production tubing, drill pipe, or well casing.

The cutting tool 10 of FIG. 1 includes a substantially cylindrical body 16 in which is housed a motor 18 (shown in dashed outline) that rotates a cutting head 20 shown provided on a lower end of the cutting tool 10. A drive shaft 23 couples the motor 18 to the cutting head 20. Pivoted out from the cutting head 20 is a cutting assembly 24 that is made up of a blade drive assembly 26 and an attached circular cutting blade 28 for severing or machining the tubular 14. Power from the motor 18 can be delivered through the shaft 23, or other gearing means (not shown) for rotating the cutting head 20. A feed rod 22 (FIG. 2) transfers power for pivoting the cutting assembly 24 from a stowed position within the cutting head 20 into a cutting position and for rotating the cutting blade 28. On the lowermost portion of the cutting tool 10 is a lubricant dispenser section 30 for retaining and dispensing a lubricant 32 that enhances the cutting and machine process of the tubular 14.

A controller 34 disposed at surface may be employed for relaying commands to or otherwise controlling the cutting tool 10. The controller 34 may be a surface truck (not shown) disposed at the surface as well as any other currently known or later developed manner of controlling a wellbore tool from the surface. The controller 34 can communicate with the cutting tool 10 via a wireline 36 shown attached to an upper end of the cutting tool 10. Optionally, the cutting tool 10 can be deployed on tubing, coiled or otherwise, slickline, or cable. Also illustrated schematically is a power supply 38 shown disposed on the surface above the wellbore 12 and also in communication with the wireline 36. The power supply 38 can selectively provide power to the cutting tool 10 via the wireline 36. Included optionally is an information handling system 40 that may be coupled with the controller 34 either in the same location or via some communication either wireless or hardwire. Other means may be used for disposing the cutting tool 10 within a particular tubular. Examples of these include drill pipe, line pigs, and tractor devices for locating the cutting tool 10 within the tubular 14.

Figure 2:
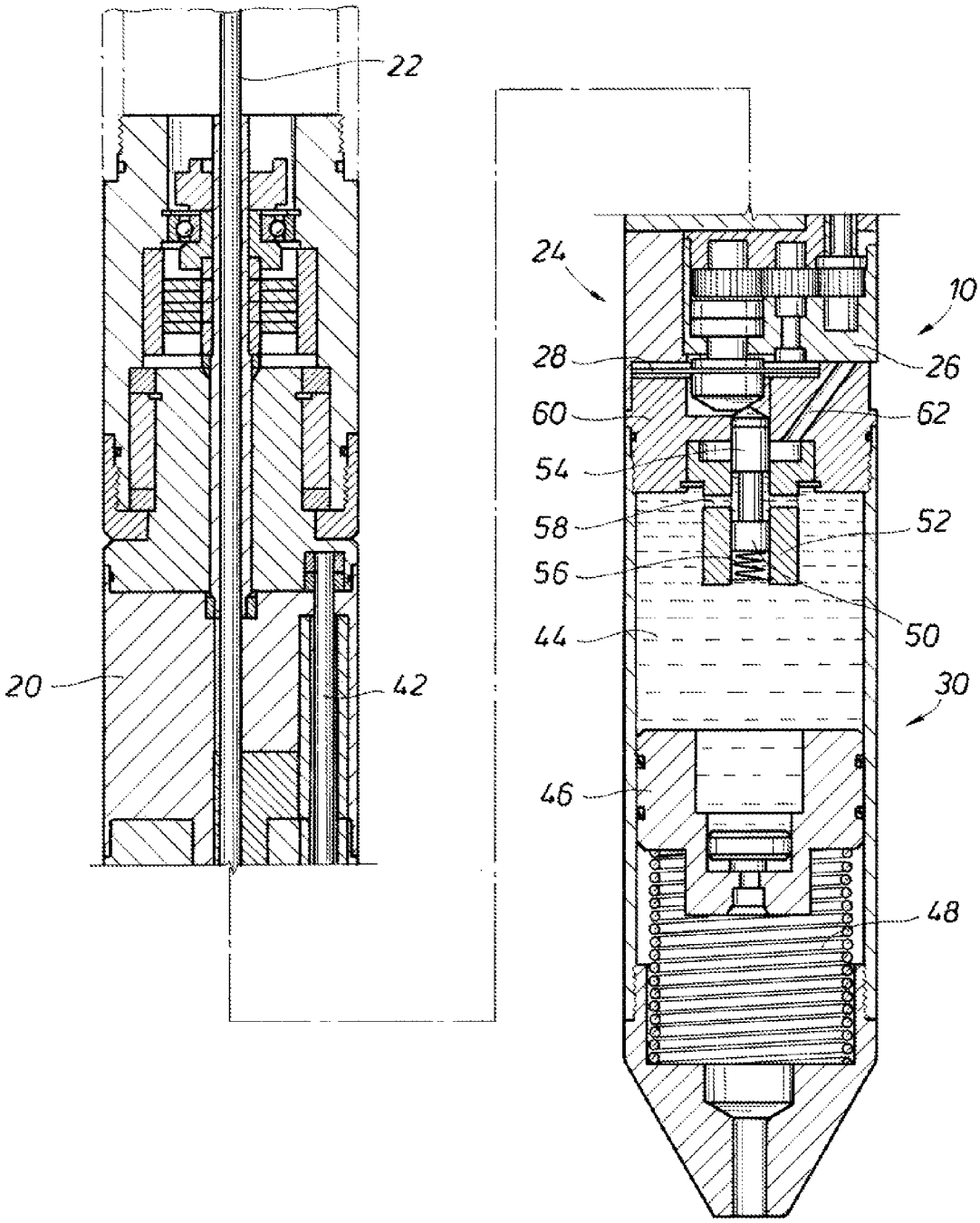
FIG. 2 is a side sectional view of a portion of the cutting tool of FIG. 1.

Referring now to FIG. 2, a side sectional view is shown of the lubricant dispenser section 30 of FIG. 1. Here the feed rod 22 is shown projecting along the axis of the cutting tool 10 and having an end attached to the cutting head 20. A blade drive shaft 42, has a lower end coupled to the blade drive assembly 26 for delivering rotational power to the cutting blade 28. Power for the pivot shaft 42 can be provided directly from the motor 18, or through a gearing arrangement (not shown) between the pivot shaft 42 and drive shaft 22. A cavity within the lubricant dispense section 30 defines a lubricant reservoir 44 for housing and storing the lubricant 32 of FIG. 1 as the cutting tool 10 is being deployed within the tubular 14. An annular piston 46 is coaxially provided within the reservoir 44 and biased towards the cutting assembly 24 by a spring 48 that is also coaxially set within the lubricant dispenser section 30.

Further illustrated in FIG. 2 is a lubricant shuttle valve assembly 50 that has an end projecting into the reservoir 44. In an example embodiment, the shuttle valve assembly 50 regulates the flow of lubricant from the reservoir 44 and adjacent to the cutting blade 28. The shuttle valve assembly 50 includes a shuttle valve body 52 that as illustrated has a largely annular configuration. A cylindrically shaped shuttle valve 54 is shown that is selectively movable axially through the shuttle valve body 52. Optionally, a biasing spring 56 is set within the valve body 52 on an end of the shuttle member 54 that biases the shuttle member 54 towards the cutting assembly 24. Radial ports 58 extend through a side wall of the shuttle valve body 52 to provide communication between the reservoir 44 and within the shuttle valve body 52. An annular bulkhead 60 is shown in that defines an upper end of the lubricant dispenser section 30 and in which an end of the shuttle valve assembly 50 opposite the reservoir 44 is anchored. A passage 62 is formed through the bulkhead from the side adjacent the shuttle valve assembly 50 and to the blade drive assembly 26.

Figure 3:
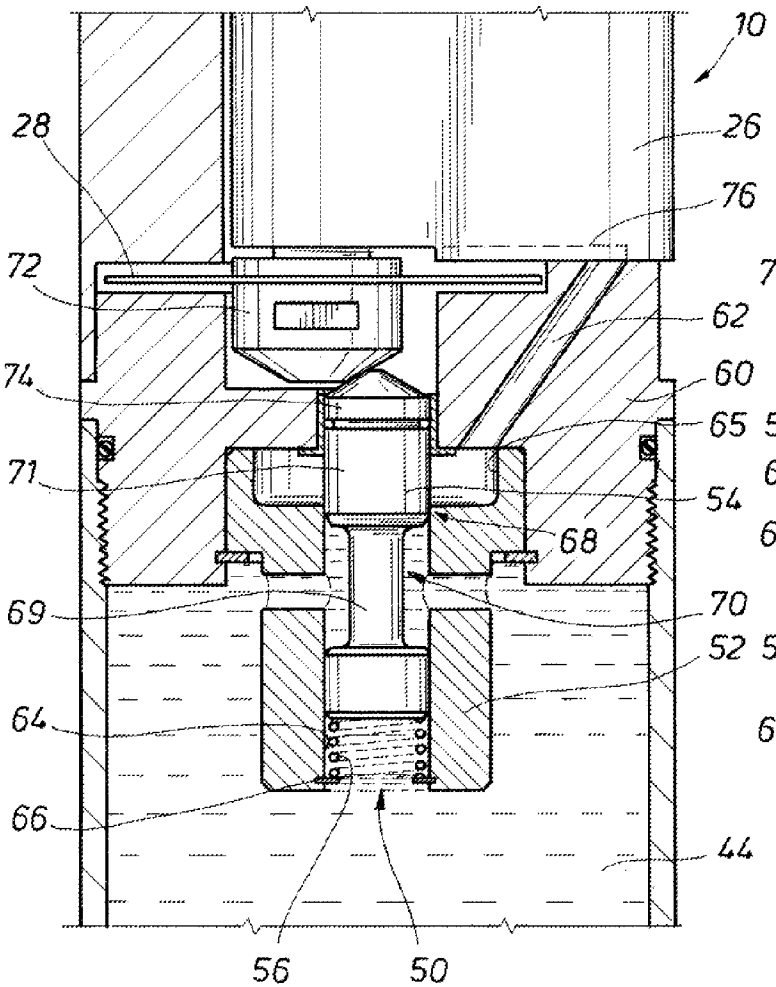
FIG. 3 is a side partial sectional view of a lubricant shuttle valve assembly in a closed position.

Referring now to FIG. 3, the shuttle valve assembly 50 is illustrated in a partial side sectional view and in what is referred to as a closed position. When in the closed position, the shuttle valve assembly 50 provides a flow barrier between the lubricant reservoir 44 and the passage 62. Also shown with more specificity is a bore within the shuttle valve body 52 that is made up of a smaller bore 64 adjacent the reservoir 44 and an enlarged bore 65 proximate the portion of the valve assembly 50 facing the bulkhead 60. Within the smaller bore 64 a snap ring 66 is set within a groove. The spring 56 can be supported by the snap ring 66 so it can apply the biasing force against the shuttle member 54. A transition 68 defines the border between the enlarged bore 65 and smaller bore 64. In the embodiment of FIG. 3, the transition area is circumscribed by the bulkhead 60.

In the example embodiment of FIG. 3, the shuttle member 54 diameter changes to thereby define a smaller diameter section 69 and an annulus is formed between the smaller diameter section 69 and the inner circumference of the smaller bore 64. The diameter of the shuttle member 54 transitions radially outward and forms a larger diameter portion 71 that is in sealing engagement with the smaller bore 64. The sealing engagement between the larger diameter portion 71 and smaller bore 64 provides the barrier to prevent flow communication from the reservoir 44 into the passage 62.

A cap nut 72 is shown on a side of the blade 28 and facing the valve assembly 50. In the embodiment of FIG. 3, the blade drive assembly 26 is in the stowed position, so that the cap nut 72 axially retains the shuttle member 54 within the valve assembly 50. While retained in the valve assembly 50 by the cap nut 72, the shuttle member 54 is in a closed configuration that prevents lubricant flow through the valve assembly 50. In the example embodiment of FIG. 3, an insert 74 is shown provided on an upper end of the shuttle member 54 and in contact with the cap nut 72. Optionally, the contacting surfaces between the cap nut 72 and insert 74 have corresponding profiles as shown. Further illustrated in the example embodiment of FIG. 3 is a recess 76 (shown in dashed outline) formed in a lower facing surface of the blade drive assembly 26 and disposed adjacent an exit end of the passage 62.

Figure 4:
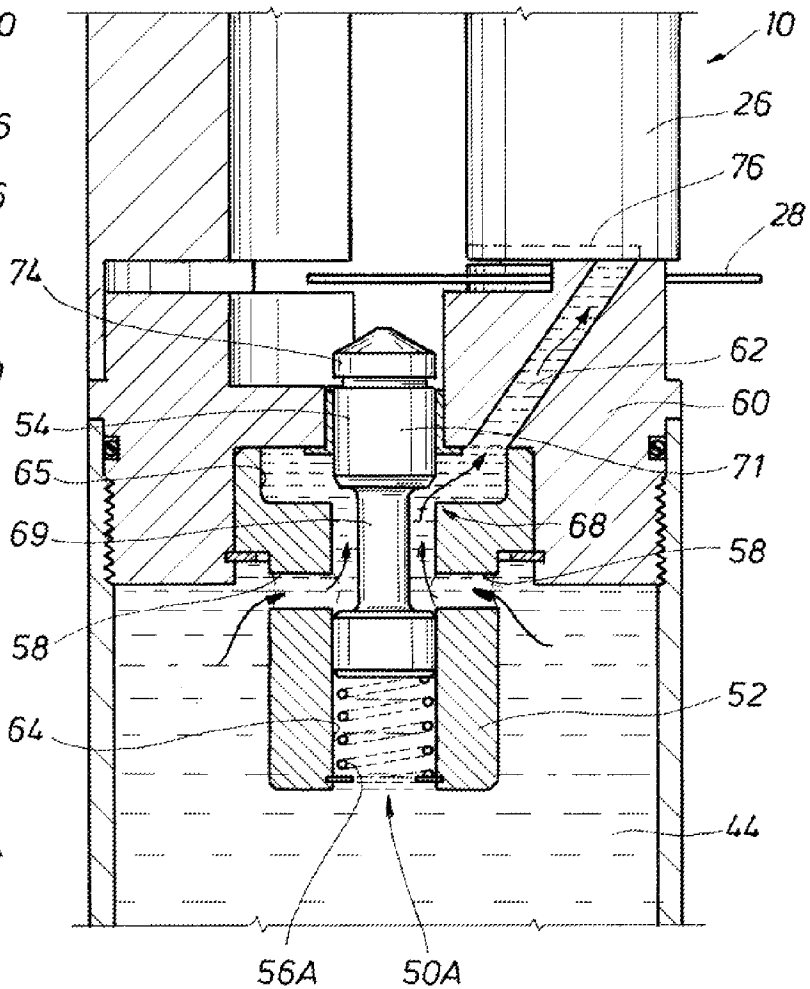
FIG. 4 is a side partial sectional view of the lubricant shuttle valve assembly of FIG. 3 in an open position.

In FIG. 4, the shuttle valve assembly 50 is illustrated in an open position thereby allowing flow of lubricant from the reservoir 44 through the passage 62 for delivery onto a cutting surface. The recess 76 provides a flow path that can direct the lubricant onto a surface of the blade 28 that is oppositely facing from the reservoir 44. In the example embodiment of FIG. 4, the blade drive assembly 26 has been pivoted away from the stowed position and into the cutting position, thereby disengaging the cap nut 72 from the insert 74 and allowing the shuttle member 54 to move axially within the valve assembly 50A as upwardly biased by the spring 56A. The axial movement of the shuttle member 54 repositions the larger diameter portion 71 away from the smaller bore 64 thereby removing the sealing barrier of the larger diameter portion 71 and smaller bore 64. The moved shuttle member 54 of FIG. 4 is in a position where its smaller diameter section 69 extends from the radial ports 58 and past the transition 68 so at least a portion of the smaller diameter section 69 is circumscribed by the enlarged bore 65. As such, the lubricant flows into the annulus 70 from within the reservoir 44, into the enlarged bore 65, the passage 62, the recess 76, where it is then delivered to the cutting surface within the tubular 14. An advantage of the similarly sloped profiles on the cap nut 72 and insert 74 that when the blade drive assembly 26 is pivoted inward to the stowed position, it can then slide across the insert 74 and gradually urge the shuttle member 54 axially into the closed position of FIG. 3.

Figure 5:
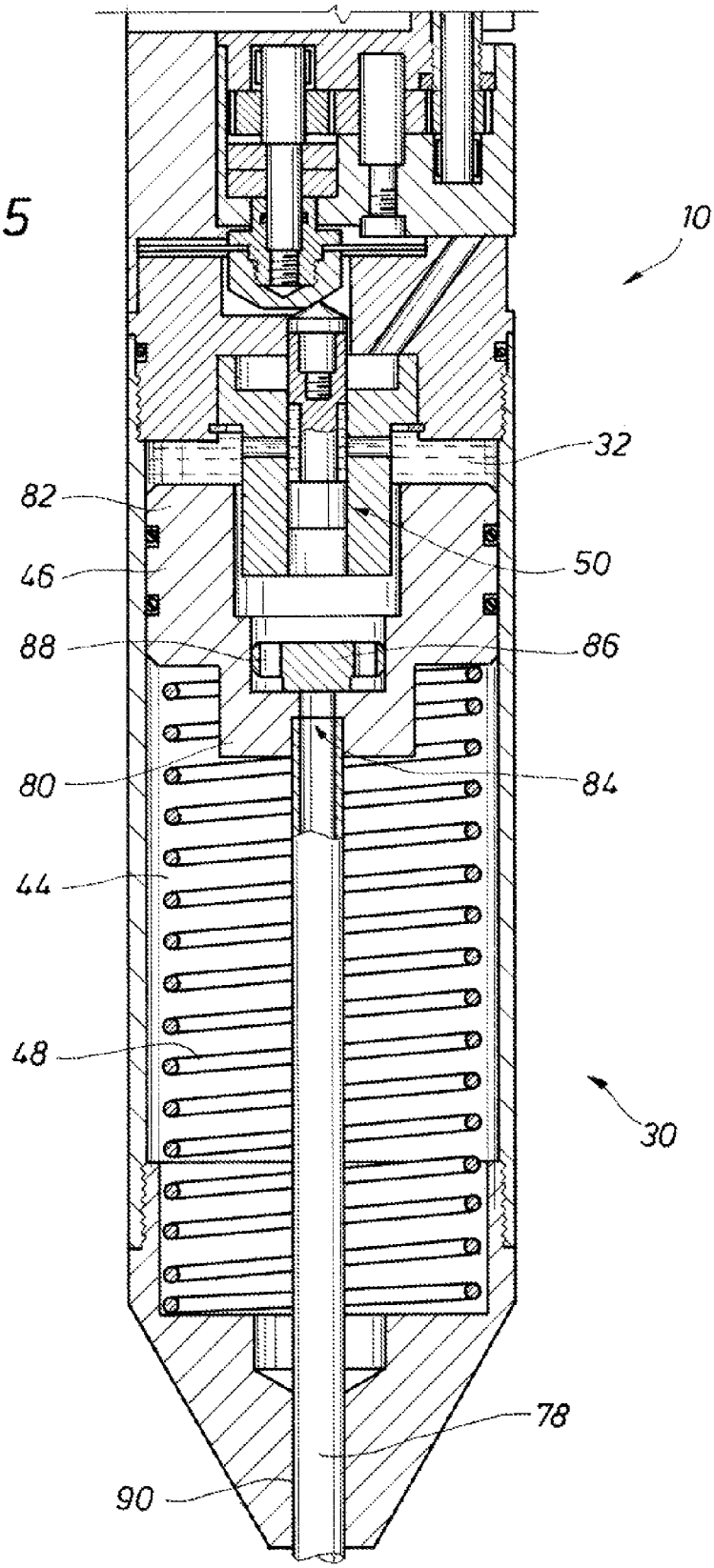
FIG. 5 is a is a side partial sectional view of an example of refilling a lubricant reservoir.

Shown in FIG. 5 is a sectional view of the lubricant dispenser section 30 wherein a majority of the lubricant 32 has been discharged from the reservoir 44 and the piston 46 is adjacent the shuttle valve assembly 50. The reservoir may be refilled through a fill tube 78 shown inserted coaxially through the lower end of the dispenser section 30 and having an end set into a lower end 80 of the piston 46. In the embodiment of FIG. 5, the piston 46 further includes a main body 82 having an outer circumference that extends radially outward to the inner surface of the reservoir 44 and past the outer periphery of the lower end 80 of the piston 46. A bore 84 extends axially through the piston 46 and transitions radially outward within the lower end 80 and profiled to receive a check valve 86 therein. Axial ports 88 through the check valve 86 allow lubricant to flow through the check valve during the refilling process. Ultimately, lubricant flows through the ports 88 and the check valve 86, through the upper end of the bore 84 to urge the piston 46 into contact with the spring 48. Moreover, the check valve prevents loss of lubricant through the inlet 90 that projects through the lower end of the dispenser section 30. Accordingly, by use of the fill tube 78, the lubricant can be quickly recharged into the lubricant dispenser section 30 and the cutting tool 10 quickly redeployed for additional operations.

Examples of lubricants include hydrogenated polyolefins, esters, silicone, fluorocarbons, grease, graphite, molybdenum disulfide, molybdenum sulfide, polytetrafluoroethylene, animal oils, vegetable oils, mineral oils, and petroleum based oils. Lubricant 40 inserted between the blade 28 and the inner surface of the tubular 14 enhances machining and cutting of the tubular 14.

The present disclosure further includes using a cutting tool with a lubricant to cut tubulars with increased chrome amounts, as well as alloying elements such as nickel, vanadium, molybdenum, titanium, silicium. This method is also applicable to cutting in environments with water, salt water, air, gas, and drilling fluids.

The improvements described herein, therefore, are well adapted to carry out the objects and attain the ends and advantages mentioned, as well as others inherent therein. While presently preferred embodiments have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A cutting tool for cutting a downhole tubular comprising:
- a cutting member selectively moveable between a stowed position within the housing and a cutting position in cutting contact with the tubular;
- a lubricant dispenser having a reservoir with lubricant stored therein;
- a lubricant discharge having an inlet end and a discharge end that is directed towards the cutting member when the cutting member is in the cutting position; and
- a lubricant shuttle valve assembly comprising:
  - a valve body having a bore;
  - a port through the valve body for communicating the lubricant with the bore, a shuttle member selectively moveable in the bore from a closed position to an open position, and
  - a recess in an outer surface of the shuttle member that registers with the port when the shuttle member is in the closed position and when the shuttle member is in the open position, the recess registers with the port and the inlet end of the lubricant discharge, so that the lubricant reservoir and discharge end of the lubricant discharge are in communication.

2. The cutting tool of claim 1, further comprising a spring biasing a piston in the reservoir to urge lubricant from the reservoir, through the shuttle valve assembly, and the lubricant discharge.

3. The cutting tool of claim 1, wherein the recess defines an annulus between the shuttle member and the bore.

4. The cutting tool of claim 3, wherein the outer surface of the shuttle member adjacent the bore projects radially outward into sealing contact with an inner surface of the bore to define a flow barrier between the annulus and the lubricant discharge when the shuttle member is in the closed position.

5. The cutting tool of claim 1, wherein the shuttle member is mechanically coupled to the cutting member when the cutting member is in the stowed position thereby retaining the shuttle member in the closed position.

6. The cutting tool of claim 5, wherein when the cutting member moves into the cutting position, a biasing spring in the bore urges the shuttle member into the open position.

7. The cutting tool of claim 1, further comprising a piston in the reservoir having an end attached to a fill tube for refilling the reservoir with lubricant and a check valve in the piston that defines a flow barrier through the piston for retaining lubricant in the reservoir.

8. The cutting tool of claim 1, further comprising a housing wherein the cutting member is mounted on a cutting assembly that pivots on the housing from a stowed into a cutting position, and wherein the cutting assembly includes a channel for directing lubricant from the discharge end of the lubricant discharge onto a side of the cutting member.

9. The cutting tool of claim 1, wherein the cutting tool is deployed from the surface on wireline.

10. The cutting tool of claim 1, further comprising a plurality of ports in the valve body.

11. A cutting tool for cutting a downhole tubular comprising:

a housing;

a cutting assembly having a cutting blade that is selectively moveable between a stowed position within the housing and a cutting position in cutting contact with the tubular;

a reservoir for storing lubricant therein;

a passage having an inlet and a discharge directed towards the cutting member when the cutting member is in the cutting position; and a lubricant shuttle valve assembly comprising:

a valve body having a smaller bore and an enlarged bore adjacent to and coaxial with the smaller bore;

a port through the body adjacent the smaller bore, a shuttle member having a smaller diameter section that defines an annulus between the shuttle member and the smaller bore and a larger diameter section adjacent the smaller diameter section that is in sealing contact with the smaller bore when the larger diameter section within the smaller bore, so that when the shuttle member positioned with the smaller diameter section is within both the smaller bore and the enlarged bore, the port and passage are in communication thereby providing lubrication communication to the cutting member.

12. The cutting tool of claim 11, further comprising a piston in the reservoir that is biased with a spring towards the lubricant shuttle valve assembly to urge lubricant through the lubricant shuttle valve assembly.

13. The cutting tool of claim 11, wherein a cap on the cutting member retains the shuttle member in the closed position when the cutting member is in the stowed position.

14. The cutting tool of claim 13, further comprising a spring biased against the shuttle member for axially urging the shuttle member into the open position when the cutting member moves into the cutting position and disengages the cap from the shuttle member.

15. The cutting tool of claim 13, wherein the respective surfaces of the cap and shuttle member that are in contact are profiled with a substantially similar slope.

* * * * *